US009528407B2

(12) United States Patent
Nomura et al.

(10) Patent No.: US 9,528,407 B2
(45) Date of Patent: Dec. 27, 2016

(54) HIGH EFFICIENCY CYCLONE OIL SEPARATOR DEVICE

(71) Applicant: Toyota Motor Engineering & Manufacturing North America, Inc., Erlanger, KY (US)

(72) Inventors: Shohei Nomura, Ann Arbor, MI (US); Tenghua Tom Shieh, Ann Arbor, MI (US); Swetha Minupuri, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 43 days.

(21) Appl. No.: 14/084,922

(22) Filed: Dec. 12, 2013

(65) Prior Publication Data

US 2015/0167515 A1 Jun. 18, 2015

(51) Int. Cl.
*F01M 13/04* (2006.01)

(52) U.S. Cl.
CPC ..... *F01M 13/04* (2013.01); *F01M 13/0416* (2013.01); *F01M 2013/0427* (2013.01); *F01M 2013/0433* (2013.01); *F01M 2013/0461* (2013.01)

(58) Field of Classification Search
CPC ..... F01M 2013/0427; F01M 2013/0433; F01M 2013/0461; F01M 2013/0038; F01M 2013/0072; F01M 2013/0422; F01M 13/04
USPC ..... 123/572–574
See application file for complete search history.

(56) References Cited

U.S. PATENT DOCUMENTS

| | | | | |
|---|---|---|---|---|
| 4,378,289 | A | 3/1983 | Hunter | |
| 6,210,575 | B1 | 4/2001 | Chase et al. | |
| 6,279,556 | B1 * | 8/2001 | Busen et al. | 123/572 |
| 6,412,478 | B1 * | 7/2002 | Ruehlow et al. | 123/572 |
| 6,626,163 | B1 * | 9/2003 | Busen et al. | 123/572 |
| 6,739,456 | B2 | 5/2004 | Svoronos et al. | |
| 6,832,603 | B2 | 12/2004 | Knollmayr | |
| 7,007,682 | B2 | 3/2006 | Takahashi et al. | |
| 7,383,829 | B2 | 6/2008 | Shieh | |
| 7,406,961 | B2 | 8/2008 | Hilpert et al. | |
| 2003/0230291 | A1 * | 12/2003 | Ko | F02M 25/06 123/572 |
| 2006/0090737 | A1 | 5/2006 | Pietschner | |
| 2007/0151215 | A1 * | 7/2007 | Knittel | B01D 45/12 55/345 |
| 2008/0099001 | A1 * | 5/2008 | Vichinsky | F02M 25/06 123/574 |
| 2009/0229585 | A1 * | 9/2009 | Tanaka et al. | 123/573 |
| 2011/0146639 | A1 * | 6/2011 | Martinengo et al. | 123/573 |

(Continued)

*Primary Examiner* — Marguerite McMahon
(74) *Attorney, Agent, or Firm* — Dinsmore & Shohl LLP

(57) ABSTRACT

An oil separation device of the having a separation chamber configured to separate micron particles of oil from crankcase gas is provided. The separation chamber has passage having a first end and a second end, the second end has a diameter smaller than the first end. The second end is spaced apart from a bottom wall of a chamber. Crankcase gas is drawn along the passage in the same direction as oil falling along the inner wall of the passage. Crankcase gas exits the second end in a path different than oil falling from the second end. The oil separating device may further include a dividing wall having through-holes and a blocking wall disposed above the through-holes so as to facilitate the removal of oil from crankcase gas.

14 Claims, 6 Drawing Sheets

(56) References Cited

U.S. PATENT DOCUMENTS

2011/0315131 A1* 12/2011 Lohr ..... F02M 25/06
123/572
2015/0114368 A1* 4/2015 Kurita et al. ..... 123/573

* cited by examiner

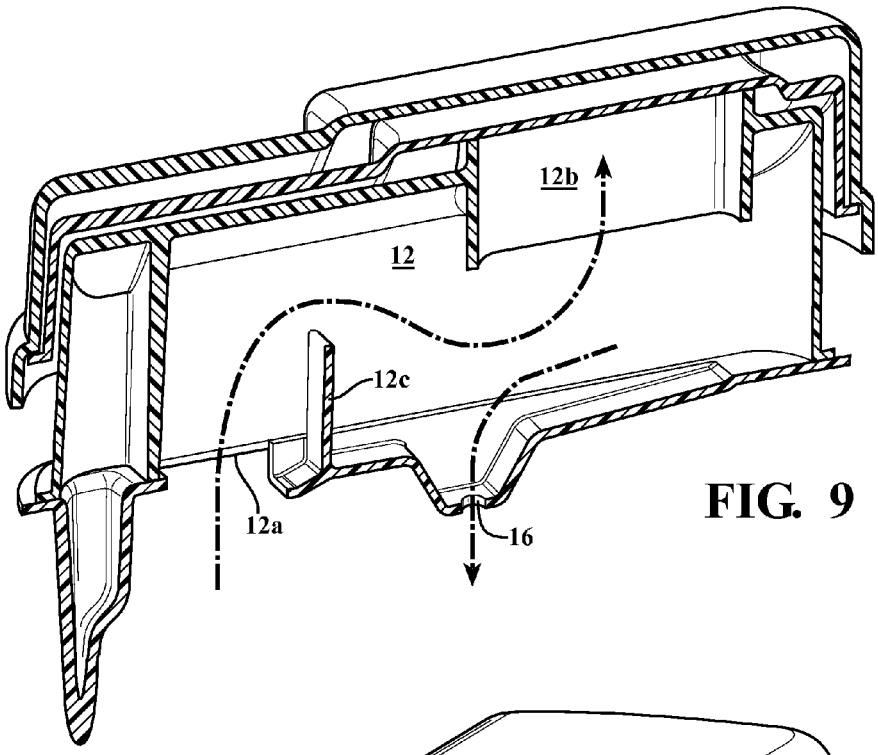
FIG. 9
FIG. 10
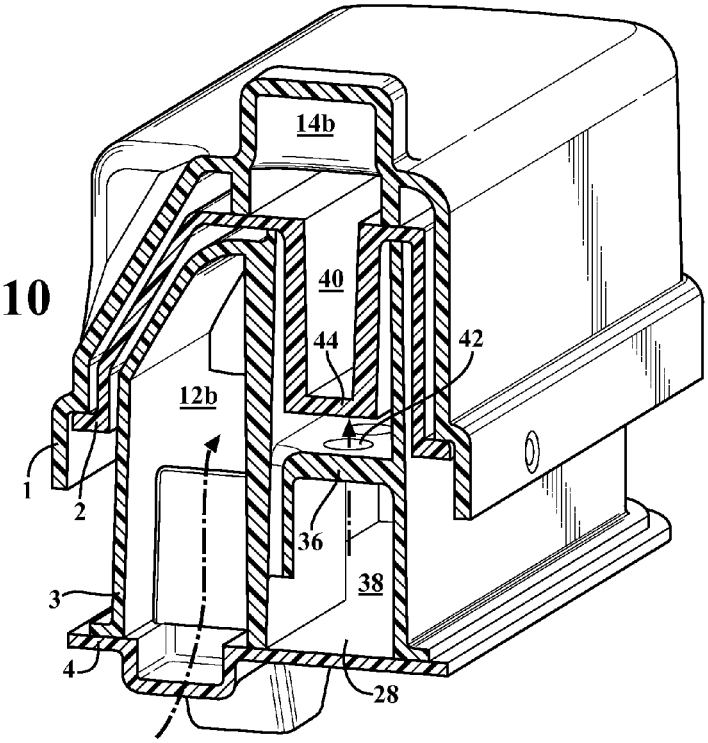

HIGH EFFICIENCY CYCLONE OIL SEPARATOR DEVICE

FIELD OF THE INVENTION

The present invention relates to oil separation devices configured to separate oil from crankcase gas generated during the operation of an internal combustion engine.

BACKGROUND OF THE INVENTION

An internal combustion engine includes a combustion chamber and a crankcase. The combustion chamber is where a fuel air mixture is burned to cause movement of a set of reciprocating pistons. The crankcase houses the crankshaft driven by the pistons. During operation, it is normal for the engine to generate "crankcase gas." Crankcase gas is the combusted gas that leaks from the combustion chamber past the piston-cylinder gap into the crankcase. Crankcase gas includes oil. If this oil is not removed, it will be consumed by the engine when the crankcase gas is returned to the combustion chamber of the engine via the intake manifold.

It is known to use a Positive Crankcase Ventilation ("PCV") system for filtering crankcase gas so as to remove oil particles and prevent those particles from the entering the engine and being consumed in the combustion process. Such PCV systems may also include an oil separating device configured to remove oil from crankcase gas. The crankcase gas flows into localized high velocity areas of the oil separator and impact at high velocity into a punched-hole impact plate ("PIP") to promote separation of oil from the gas. The oil is re-introduced back to a sump via a drain device which is located generally at the bottom of the oil separator to allow for gravity to assist the drainage of oil. The sump generally holds excess oil in the system.

Accordingly, it is an objective of the present invention to increase the amount of oil separated from gas as compared to previous designs.

SUMMARY OF THE INVENTION

An oil separating device for separating oil from crankcase gas generated in an internal combustion engine is provided. The oil separating device includes an inlet and an outlet. The inlet is upstream and in fluid communication with the separation chamber. The inlet is configured is to receive the crankcase gas. The outlet is configured to allow crankcase gas to be sent to an intake manifold of the engine. The oil separating device further includes a separation chamber having a first end. The first end is elevated relative to a second end so as to form a passage extending along an axis. The first end has a larger diameter than a diameter of the second end. The first and second ends are disposed on respective first and second planes. The first and second planes are generally parallel to each other and orthogonal to the axis. The outlet is downstream from the second plane and displaced from the axis and second plane.

In operation, crankcase gas enters the separation chamber though the inlet, micron size particles of oil are separated from the crankcase gas within the separation chamber, and cling to the inner wall of the separation chamber and fall towards the second end. Thus, within the walls of the separation chamber, separated oil and crankcase gas flows in the same direction. Further, crankcase gas helps urge the oil out of the second end as both are traveling in the same direction. The separated oil drops via gravity and flows to a sump, and the crankcase gas is drawn into the outlet away from the direction of the falling oil.

The oil separating device includes a housing. The housing includes a pair of side walls, a top wall, and a bottom wall so as to define a chamber. The bottom wall has an oil drain.

The oil separating device includes a first oil separation portion and a second oil separation portion disposed within the chamber. The first oil separation portion is downstream the inlet and includes a separation chamber. The separation chamber is configured to remove micron size particles of oil from crankcase gas. The separation chamber is disposed between the inlet and the second separation portion. The separation chamber is in fluid communication with both the second oil separation portion and an inlet. The gas outlet is disposed downstream from the second oil separation portion.

The oil separating device further includes a dividing wall disposed within the second separation portion. The dividing wall extends between the separation chamber and one of the pair of side walls of the housing and is disposed between the top wall and the bottom wall of the housing, partitioning the second separation portion so as to define a first chamber and a second chamber. The dividing wall includes one or more through holes. A blocking wall is disposed between the dividing wall and the top wall of the housing.

In operation, crankcase gas enters the oil separation device through the inlet and is directed into the separation chamber where micron size particles of oil are separated from the crankcase gas. The separated oil falls onto the bottom wall and crankcase gas is drawn generally laterally from the falling oil into the second oil separation chamber. The separated oil is further directed to the oil drain. The crankcase gas is then drawn through the through holes in the dividing wall and directed into a blocking wall, where oil is further separated from the crankcase gas. The crankcase gas flows out the gas outlet, and the separated oil flows back to the oil drain.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 9 shows a perspective sectional view of another portion of the second embodiment with oil and gas flow lines;

FIG. 10 shows a perspective sectional view of another portion of the second embodiment with oil and gas flow lines;

DETAILED DESCRIPTION OF THE PREFERRED EMBODIMENTS

Figure 1:
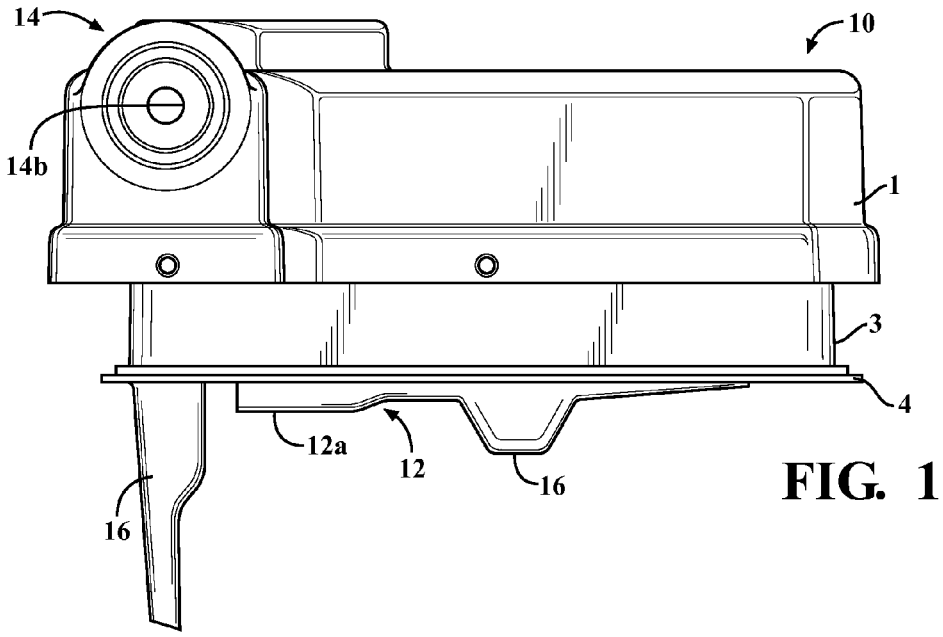
FIG. 1 shows a front view of an oil separating device.
Figure 3:
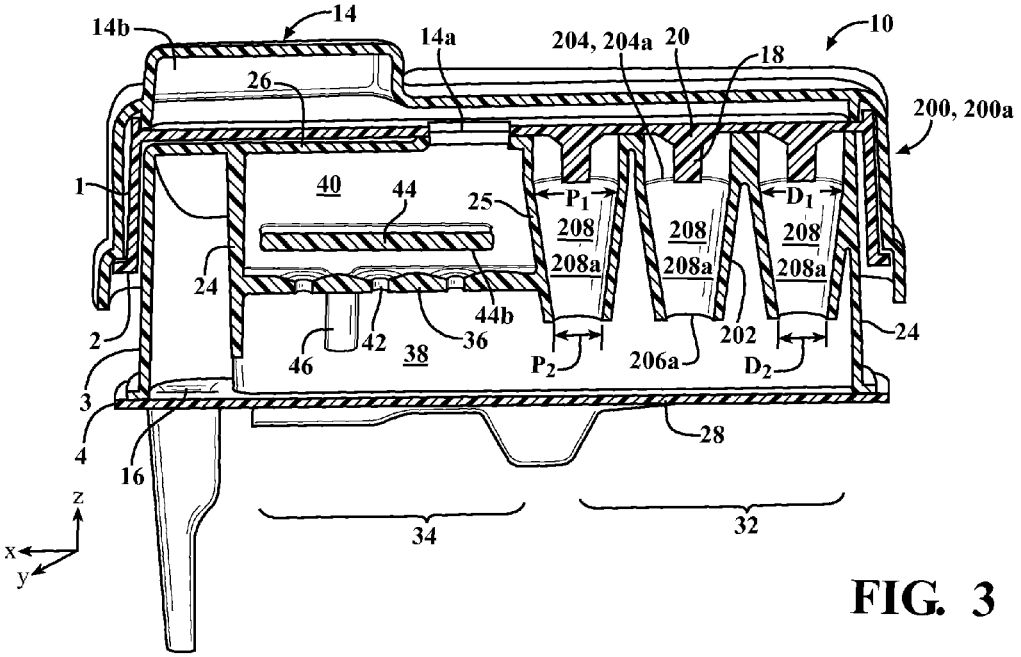
FIG. 3 shows a perspective sectional view of a portion of a first embodiment of the present invention.
Figure 4:
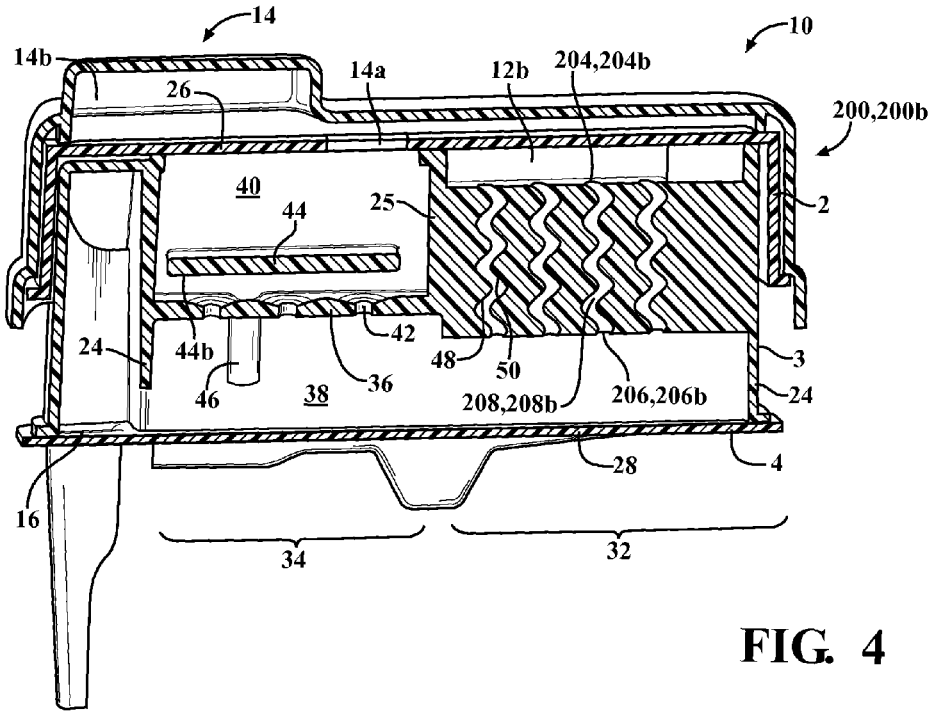
FIG. 4 shows a perspective sectional view of a portion of a second embodiment of the present invention.

With reference now to FIGS. 1, 3 and 4, an oil separating device 10 is provided. The oil separating device 10 is in fluid communication with a crankcase of an internal combustion engine (not shown). The oil separating device 10 is configured to separate oil from crankcase gas generated during the operation of the internal combustion engine. For illustrative purposes, the crankcase gas is depicted in the Figures by the alternating long and short dashed flow lines.

The oil separating device 10 includes an inlet 12, an outlet 14, and a separation chamber 200*a*, 200*b*. The inlet 12 may be fluidly coupled to a PCV system (not shown) and is configured to receive crankcase gas. The outlet 14 is downstream of the separation chamber 200*a*, 200*b* and is configured to direct crankcase gas back into the internal combustion engine's intake manifold. The oil separating device 10 further includes at least one oil drain 16 for collecting oil separated from the crankcase gas.

The separation chamber 200*a*, 200*b* is configured to separate micron size particles of oil from crankcase gas. For illustrative purposes, the separation chamber shown is configured to separate oil particles having a diameter larger than about one micron. The separation chamber 200*a*, 200*b* shown in the Figures is further configured to accommodate crankcase gas being drawn there through at a volumetric rate of up to about 60 l/min.

The separation chamber 200*a*, 200*b* is disposed downstream the inlet 12, and upstream both the outlet 14 and oil drain 16. The inlet 12 includes an inlet port 12*a* and an inlet passage 12*b* having a labyrinth structure 12*c* configured to block and redirect crankcase gas. The crankcase impacts the labyrinth structure 12*c* so as to separate particles of oil having a diameter larger than about 3 microns.

The separation chamber 200*a* has an inner wall 202 with open ends so as to define a first end 204*a* and a second end 206*a*. The first end 204*a*, when mounted to an internal combustion engine of an automotive vehicle, is elevated relative to the second end 206*a*. The first end 204*a* is larger in diameter than the second end 206*a*, D1 and D2 respectively. The first end 204*a* is in fluid communication with the second end 206*a* so as to form a passage 208*a* from which crankcase gas flows. Oil from crankcase gas coming into contact with the inner wall 202 of the separation chamber 200*a* may collect onto the inner wall 202 and pool so as to form collections of oil having a volume larger than the micron size particle. It should also be appreciated that gravity urges oil on the inner wall 202 to fall downwardly along the inner wall 202.

The first and second ends 204*a* 206*a* are disposed on planes which are relatively parallel to each other and generally orthogonal to the axial orientation of the passage 208*a*. Specifically, the first end 204*a* is disposed on a first plane "P1" and the second end 206*a* is disposed on a second plane "P2" as the first and second planes "P1" and "P2" are disposed on a plane X and Y as defined by the coordinates labeled "X", "Y", and "Z." As is shown, both the first and second planes are generally parallel to a bottom wall 205 of the oil separating device 10.

The second end 206*a* of the separation chamber 200*a* is elevated relative to the bottom wall 205. Thus, as micron size particles of oil are separated from the crankcase gas, the micron size particles of oil collect on the inner wall 202 surface of the separation chamber 200*a* and fall via gravity assist onto the bottom wall 28. Further, crankcase gas flows along the same direction as gravity, and thus as oil is collected on the inner wall 202, the directional flow of the crankcase gas within the passage 208*a* facilitates the collection of oil at the second end 206*a*, wherein the oil eventually falls onto the bottom wall 28 and crankcase gas are drawn away from the falling oil, and into the outlet port 14*a* and the outlet passage 14*b* of the outlet 14.

The second end 206*a* of the separation chamber 200*a* may be offset from the oil drain 16. More specifically, the oil drain 16 is shown laterally displaced from the axial length of the passage 208*a*. Thus, a portion of the bottom wall 28 facilitates the movement of crankcase gas laterally with respect to the axis of the passage 208*a* as the crankcase gas flows out of the second end 206*a* of the separation chamber 200*a*.

For illustrative purposes, the Figures show an outlet port 14*a* located above the second end 206*a*, 206*b* of the separation chamber. The outlet port 14*a* is displaced laterally from the axial length of the passage 208*a*, 208*b* defined between the first end 204*a* 204*b* and the second end 206*a*, 206*b* of the separation chamber 200*a*, 200*b*. Thus, as crankcase gas is drawn out the outlet port 14*a*, the crankcase gas flows laterally as the crankcase gas exits the second end 206*a*, 206*b*. The crankcase gas is drawn along a path separate from the path of the falling oil as gravity generally urges the separated micron size particles of oil downwardly in generally the same direction as the axis of the passage 208*a*, 208*b*. It should be appreciated that the location of the outlet port 14*a* with respect to the second end 206*a*, 206*b* of the separation chamber 200*a*, 200*b* is illustrative, and should not be interpreted as limiting the scope of the appended claims, and that any location of an outlet port 14*a* which facilitates the flow of crankcase gas away from the path of dropping micron size particles of oil is within the scope of the appended claims.

With reference now to FIG. 3, an embodiment of the separation chamber 200*a*, 200*b* is provided. For illustrative purposes, the common features of the embodiment of the separation chamber will be described using the same reference numeral followed by the letter "a." The separation chamber 200*a* has an inner wall 202 forming a generally frustoconical shape. More specifically, the separation chamber 200*a* includes three frustoconically-shaped inner walls 202 each generally equidistant from each other and axially aligned to each other along an axis generally parallel to the plane defined by coordinates "X" and "Y".

Each of the frustoconically shaped inner walls 202 have a first end 204*a* and a second end 206*a*, wherein each of the first end 204*a* of the inner wall 202*a* is larger in diameter than the corresponding second end 206*a*. Though each of the frustoconically shaped inner walls 202 is dimensioned generally the same as each other, it should be appreciated that the dimensions of the frustoconically shaped inner walls 202 are designed to achieve a specific engine performance and that the size and dimension of one of the frustoconically shaped inner walls 202 may be different than the other to achieve a desired engine performance.

To increase efficiency of oil separation, the separation chamber 200*a* may include an axial protrusion 18. The axial protrusion 18 extends from a top portion 20 of the oil separation device 10 along the axis of the passage 208*a*. As shown in FIG. 3, each inner wall 202*a* has an axial protrusion 18. Each axial protrusion is centered with respect to the diameter of the first end 204*a* of the inner wall 202.

The axial protrusion 18 directs incoming crankcase gas flow along the inner wall 202 of the separation chamber 200*a*. Directing the flow of crankcase gas along the inner wall 202 increases the cyclone effect within the separation chamber 200*a*. Crankcase gas flowing along the inner wall 202 travels at a higher velocity as they swirl from the first end 204*a* to the second end 206*a* of the separation chamber 200*a*. This higher velocity subjects the suspended oil to higher level of centrifugal force, inducing more oil particles to collect on the inner wall 202. To further the efficiency for the device, the axial protrusion 18 may extend past the first plane P1, thereby directing all the incoming crankcase gas along the inner wall 202.

Figure 7:
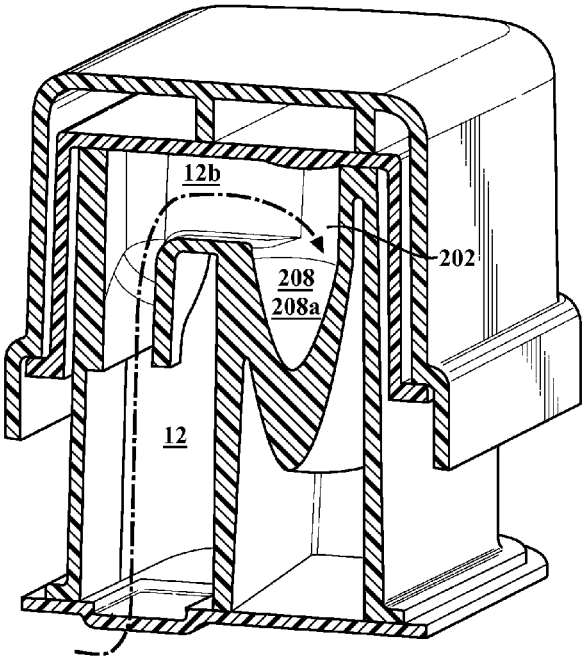
FIG. 7 shows a perspective sectional view of another portion of the first embodiment with oil and gas flow lines.

With reference now to FIG. 7, an exemplary example of the inlet passage 12*b* with respect to the separation chamber 200*a* is provided. In addition to the axial protrusion 18, the cyclone effect within the separation chamber 200*a* may be enhanced by directing the path of crankcase gas so as to preserve momentum when contacting the inner wall 202. For example, the inlet passage 12*b* may be designed such that crankcase gas enters the separation chamber 200*a* near the first end 204*a* generally perpendicular to the axis of the passage 208*a*.

A portion of the inlet passage 12*b* is generally perpendicular to the axis of the passage 208*a*, so as to feed crankcase gas into the first end of the separation chamber at a direction generally perpendicular to the axis so as to increase the cyclone effect by providing an incoming momentum of crankcase gas that is generally co-planar with the direction of swirl of the cyclone effect. This alignment transfers the motion from the incoming crankcase gas into the swirling motion, thereby increasing the rotational speed of the cyclone effect to separate more oil from the crankcase gas as described above.

Additionally, crankcase gas entering the separation chamber 200*a* from the inlet passage 12*b* can be directed such that the crankcase gas contacts the inner wall 202*a* at an angle so as to create a flow along the inner wall 202 of the separation chamber 200*a* conducive to generating a cyclone affect. Providing the flow of gas along the inner wall 202 increases the efficiency of the separation chamber 200*a* similar to the use of the axial protrusion 18 discussed above. It is understood and appreciated that an inlet structure that provides a perpendicular crankcase gas flow and/or an angular crankcase gas flow, and the axial protrusion 18 can be used alone or in various combinations to induce a cyclone effect, depending on the specific performance characteristic desired of the oil separating device 10.

With reference again to FIGS. 3 and 4, the oil separating device 10 may include a housing 22. The housing 22 includes a pair of side walls 24, and a top wall 26, and a bottom wall 28 so as to define a chamber 30. The oil drain 16 is disposed on the bottom wall 28. The chamber 30 includes a first oil separation portion 32 and a second oil separation portion 34. The first oil separation portion 32 is in fluid communication with the second oil separation portion 34. The first oil separation portion 32 is disposed in a side-by-side relationship with the second oil separation portion 34. Utilizing the first oil separation portion 32 and the second oil separation portion 34 enables the oil to be separated from the gas in multiple stages. Breaking down the separation into multiple stages provides decreased pressure drop across any individual stage when compared to separating the oil all at once. Decreasing the pressure drop helps to reduce the amount of oil reintroduced into the gas within the oil separation device 10.

The inlet 12 is disposed upstream the first oil separation portion 32. The outlet 14 is disposed downstream the second separation portion 34. The separation chamber 200*a*, 200*b* is disposed within the first separation portion 32. The separation chambers 200*a*, 200*b* are elevated and spaced apart from the bottom wall 28 of the housing, of the second end 206*a*, 206*b* of the separation chamber 200 is axially displaced from the oil drain 16.

The bottom portion includes lower portions of the first and second oil separation portions 32, 34 which are open with respect to each other, but is generally defined by the bottom wall 28 and side walls 24 of the housing. The top of the bottom portion of the first oil separation portion 32 is defined by the second end 206*a*, 206*b* of the separation chamber 200*a*, 200*b*, whereas the top of the bottom portion of the second oil separation portion 34 is defined by a dividing wall 36.

The dividing wall 36 extends between a side wall 25 of the separation chamber 200*a*, 200*b* and one of the pair of side walls 24 of the housing 22. The dividing wall 36 is disposed between the top wall 26 and the bottom wall 28 of the housing 22 so as to define a first chamber 38 and a second chamber 40. The first chamber 38 is disposed beneath the second chamber 40 and is open on one side with the bottom portion of the first oil separation portion 32. The dividing wall 36 is generally parallel to the bottom wall 28.

The dividing wall 36 includes one or more through-holes 42. The through-holes allow for crankcase gas in the first chamber 38 to flow to the second chamber 40. It is appreciated that the amount and size of the through-holes 42 is dependent on the intended performance criteria of the oil separating device 10. Decreasing the size or number of the though-holes 42 decreases the available area for the crankcase gas to flow though. Less area for flow of the crankcase gas will cause an increase in the velocity at which the gas flows through the through holes 42.

The dividing wall 36 may further include a drain tube 46. The drain tube 46 is generally a cylindrical member. A top portion of the drain tube 46 is generally chamfered so as to facilitate the drainage of oil dripping onto a top surface of the dividing wall 36. The drain tube 46 may be disposed between respective through-holes 42. Though FIG. 3 shows the oil separating device 10 having only one drain tube 46, it should be appreciated that additional drain tubes 46 may be used without limiting the scope of the invention. The drain tube 46 is in fluid communication with the first chamber 38.

The oil separating device 10 may further include a blocking wall 44. The blocking wall 44 is disposed above the dividing wall 36, and below the top wall 26. Preferably, the blocking wall 44 is disposed directly above the through-holes 42 of the dividing wall. The blocking wall 44 has a generally planar underside 44*b*, and the side edges of the blocking wall 44 are spaced apart from side walls 24 and the side wall 25 of the separation chamber 200*a*, 200*b*. The blocking wall 44 is disposed beneath the outlet port 14*b*.

It should be appreciated that the distance between the through-holes 42 and the blocking wall 44 will determine the velocity at which crankcase gas impacts the blocking wall 44. The preferred embodiment is designed to handle a volumetric flow rate up to 60 l/min, and includes through-holes 42 having a diameter of about 3 mm. The blocking wall 44 is spaced about 5 mm above the through holes 42.

Collision between the crankcase gas and the blocking wall 44 helps to further separate any oil remaining in the gas. This oil collects on the blocking wall 44, where gravity causes the oil to flow to the drain 16 to be removed from the oil separating device 10. It should be appreciated that gravity may cause the oil to flow through the drain tube 46 or through the through-holes 42. The oil drops onto the bottom wall 28 and finds its way to the oil drain 16.

The separation chamber 200*a*, 200*b* is configured to separate micron size particles of oil from crankcase gas. As stated above, the separation chamber 200*a*, 200*b* is disposed in the first oil separation portion 32 of the housing 22. The separation chamber 200*a*, 200*b* is spaced apart from and above the bottom wall 28 of the housing 22. A side wall 25 of the separation chamber 200*a*, 200*b* forms a side wall of the second oil separation portion 34.

With reference again to FIG. 3, an illustrative embodiment of the separation chamber 200*a* is provided, wherein like elements are referenced by like numbers followed by the letter "a." The separation chamber 200*a* includes three frustoconically shaped inner walls 202 each generally equidistant from each other and axially aligned to each other along an axis generally parallel to the plane defined by coordinates "X" and "Y."

Each of the frustoconically shaped inner walls 202 have a first end 204*a* and a second end 206*a*, wherein each of the first end 204*a* of the inner wall 202*a* is larger in diameter than the corresponding second end 206*a*. Though each of the frustoconically-shaped inner walls 202 are dimensioned generally the same as each other, it should be appreciated that the dimensions of the frustoconical shaped inner walls 202 are designed to achieve a specific engine performance and that the size and dimension of one of the frustoconically-shaped inner walls 202 may be different than the other to achieve a desire engine performance.

The separation chamber 200*a* may include an axial protrusion 18. The axial protrusion 18 extends from a top portion 20 of the oil separation device 10 along the axis of the passage 208*a*. The axial protrusion 18 directs incoming crankcase gas flow along the inner wall 202 of the separation chamber 200*a*. Directing the flow of crankcase gas along the inner wall 202 increases the cyclone effect within the separation chamber 200*a*. Crankcase gas flowing along the inner wall 202 travels at a higher velocity as they swirl from the first end 204*a* to the second end 206*a* the separation chamber 200*a*. This higher velocity subjects the suspended oil to a higher level of centrifugal force, inducing more oil particles to collect on the inner wall 202. To further the efficiency for the device, the axial protrusion 18 may extend past the first plane P1, thereby directing all the incoming crankcase gas along the inner wall 202.

Figure 11:
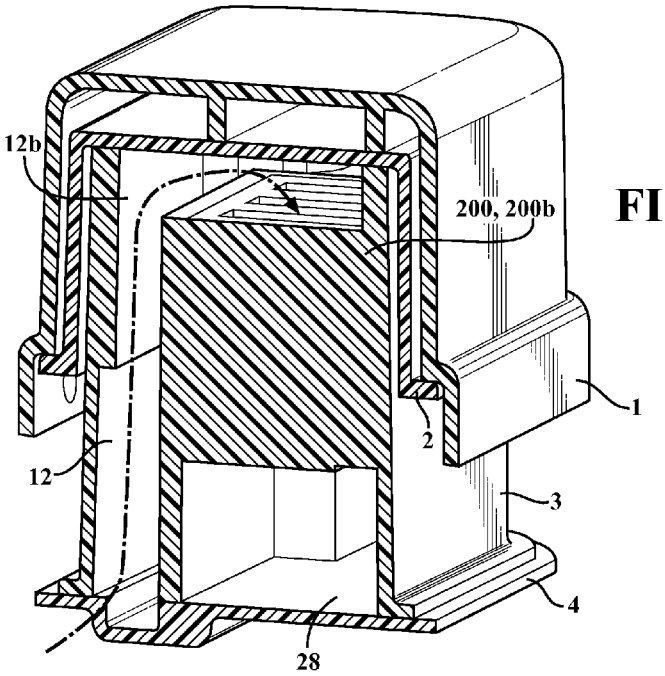
FIG. 11 shows a perspective sectional view of another portion of the second embodiment with oil and gas flow lines.
Figure 12:
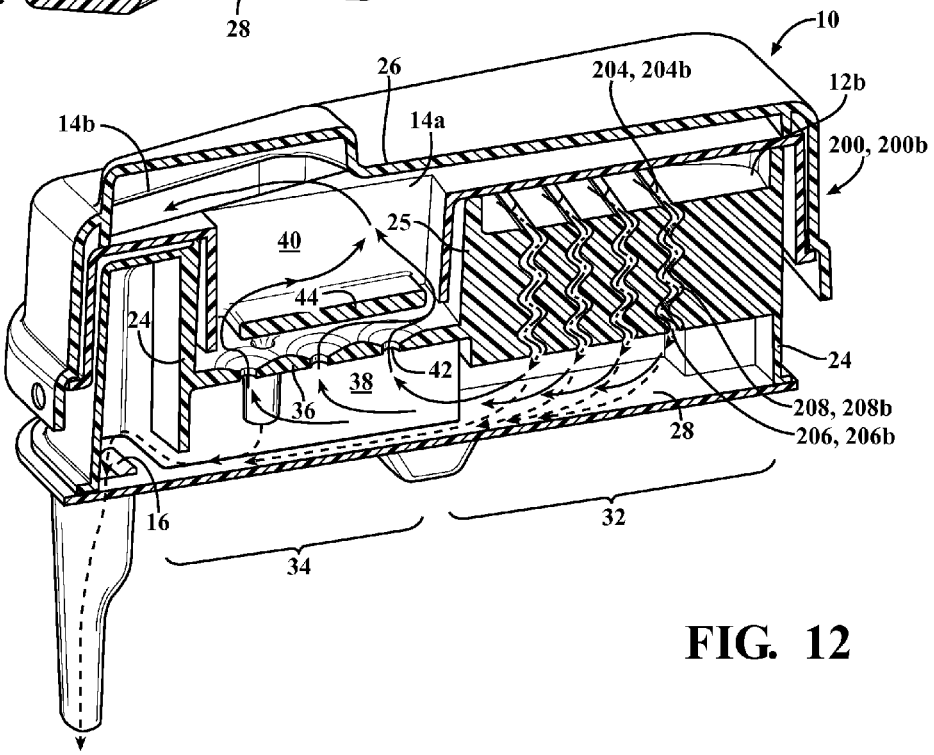
FIG. 12 shows a perspective sectional view of another portion of the second embodiment with oil and gas flow lines.

With reference now to FIGS. 4, 11, and 12, a second embodiment of the separation chamber 200*b* is shown, wherein like elements are referenced by like numbers followed by the letter "b." The separation chamber 200*b* includes a first end 204*b* and a second end 206*b*. The separation chamber 200*b* includes at least one narrow wave shaped passage 208*b* defined by a first undulating surface 48 opposite a second undulating surface 50 mirroring the first undulating surface 48. The first undulating surface 48 is spaced a predetermined distance apart from the second undulating surface 50. The narrow wave shaped passage 208*b* extends between the first end 204*b* and the second end 206*b* of the separation chamber 200*b*. It should be appreciated that the number of passages 208*b*, and the length, width and frequency, of each passage 208*b* may vary depending on the design criteria for the oil separating device 10.

The crankcase gas and separated oil exit the narrow wave shaped passage(s) 208*b* at the second end 206*b*. Upon exiting the narrow wave shaped passage 208*b*, gravity causes separated oil to fall down to the bottom wall 28 of the housing and flow out the drain 16. The crankcase gas exiting the narrow wave shaped passage(s) 208*b* are separated from the falling oil by being drawn laterally to the first chamber 38 of the second oil separation portion 34, where they will eventually flow out the outlet as discussed above.

Figure 5:
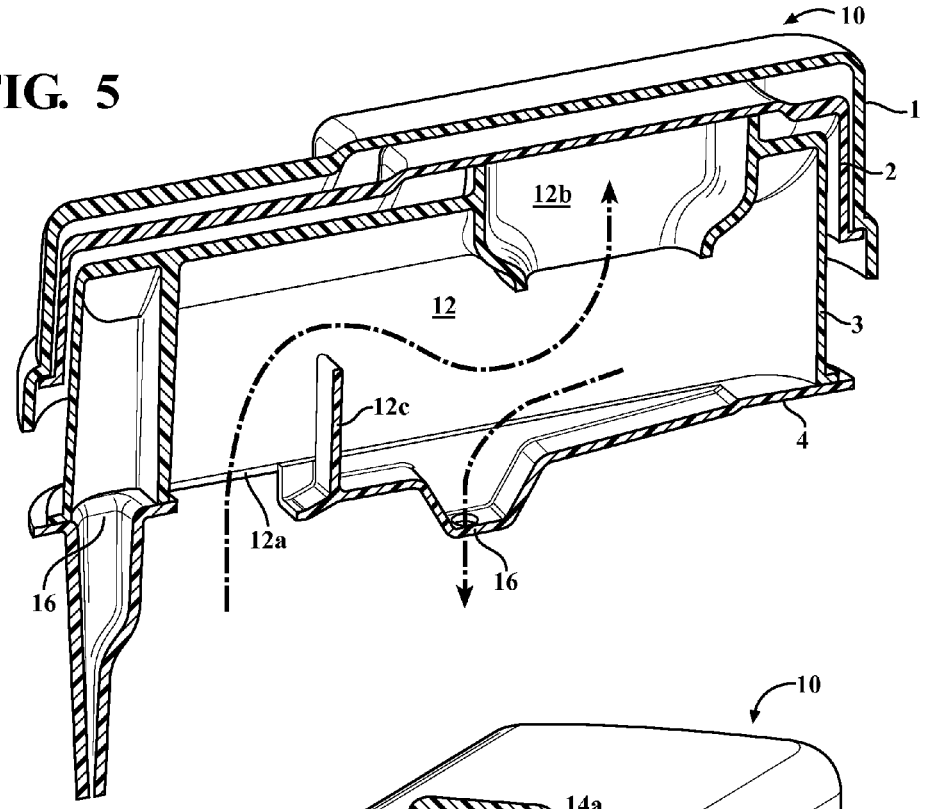
FIG. 5 shows a perspective sectional view of another portion of the first embodiment with oil and gas flow lines.
Figure 6:
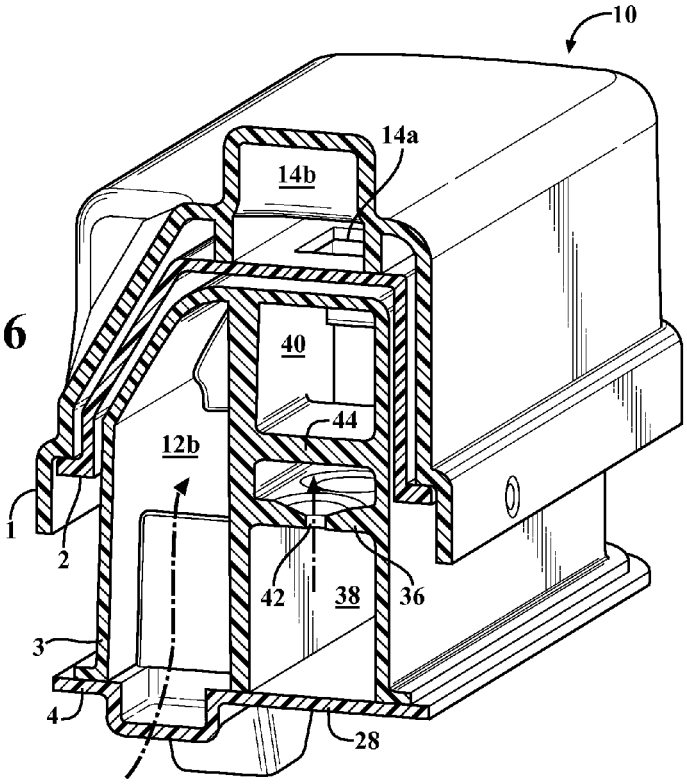
FIG. 6 shows a perspective sectional view of another portion of the first embodiment with oil and gas flow lines.

With reference now to FIGS. 5 through 12, the operation of the oil separating device 10 is provided. With reference first to FIGS. 5 and 6, crankcase gas is shown entering through the inlet 12. As crankcase gas enters the inlet port 12*a*, structure 12*c* blocks the path of the crankcase gas causing particles of oil to separate. With reference now to FIGS. 7 and 11, the crankcase gas is drawn into the inlet passage 12*b* and is directed to enter the first end 204*a*, 204*b* of the corresponding separation chamber 200*a*, 200*b*.

With reference now to FIGS. 3 and 12, the operation of the oil separation device 10 having separation chamber 200*a* is provided. Crankcase gas is drawn into passage 208*a*. The crankcase gas hits axial protrusion 18 and begins to swirl against the inner wall 202 of the separation chamber 200*a*. As the crankcase gas impacts the inner wall 202, micron size particles of oil are separated from the crankcase gas and collects on inner wall 202*a*. The separated particles of oil accumulate on the inner wall 202*a* and gravity as well as the path of the crankcase gas urges the oil down to the second end 206*a* where the oil eventually falls onto the bottom wall 28. As the crankcase gas exits the second end 206*a*, the crankcase gas is drawn away from the falling oil into the second oil separation portion 34.

Figure 8:
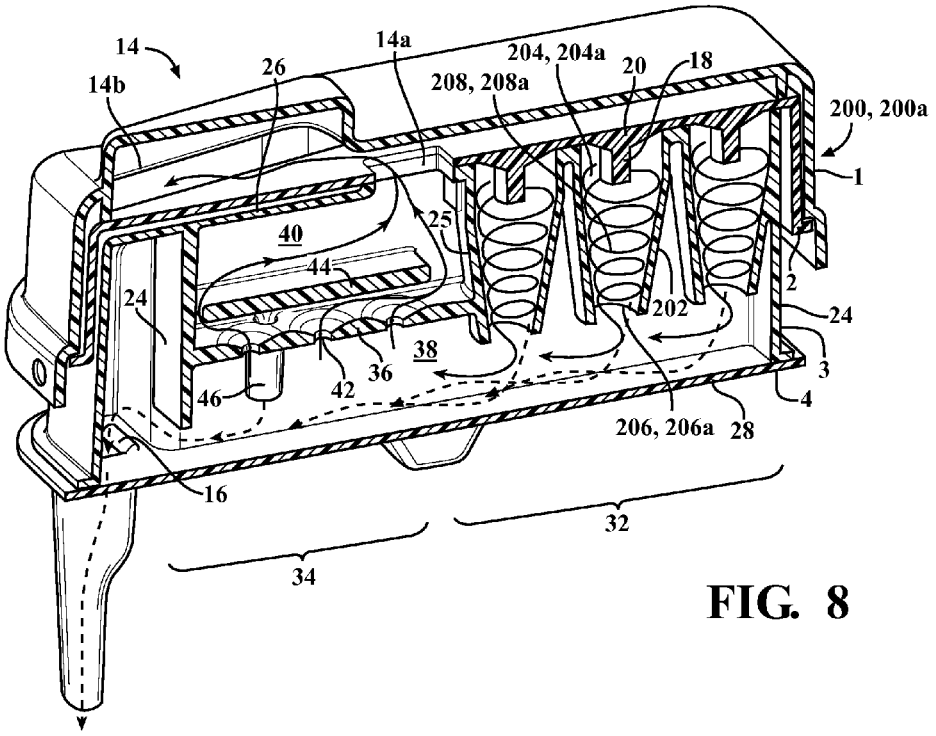
FIG. 8 shows a perspective sectional view of another portion of the first embodiment with oil and gas flow lines.

With reference now to FIGS. 4 and 8, the operation of the oil separation device 10 having separation chamber 200*b* is provided. Crankcase gas is drawn into passage 208*b*. As the crankcase gas impacts either the first or second undulating surface 48, 50 micron size particles of oil are separated from the crankcase gas and collects on both the first and second undulating surfaces 48, 50. The separated particles of oil accumulate on the first and second undulating surfaces 48, 50 and gravity as well as the path of the crankcase gas urges the oil down to the second end 206*b* wherein the oil eventually falls onto the bottom wall 28. As the crankcase gas exits the second end 206*b*, the crankcase gas is drawn away from the falling oil into the second oil separation portion 34.

The second end 206*a*, 206*b* of the separation chamber 200*a*, 200*b* may be offset from oil drain 16. The oil drain 16 is shown laterally displaced from the axial length of the passage 208*a*, 208*b*. Thus, a portion of the bottom wall 28 facilitates the movement of crankcase gas laterally with respect to the axis of the passage 208*a*, 208*b* as the crankcase gas flows out of the second end 206*a*, 206*b* of the separation chamber 200*a*, 200*b*.

Crankcase gas exiting the second end 206*a*, 206*b* of the separation chamber 200*a*, 200*b* flow laterally from the first oil separation portion 32 to the first chamber 38 of the second oil separation portion 34. The lateral flow of the crankcase gas draws the crankcase gas away from the oil separated by the separation chamber 200*a*, 200*b* as the oil falls from the separation chamber 200*a*, 200*b* to the bottom wall 28 of the housing 22. The separated oil flows along the bottom wall 28 and out through the oil drain 16.

With reference now to FIGS. 3, 4, 6, and 10, the crankcase gas is further drawn into the second oil separation portion 34 wherein crankcase gas is drawn upwardly into the dividing wall 36. As crankcase gas impacts the undersurface of the dividing wall 36, oil is further separated from the crankcase gas. The separated oil drops onto the bottom wall 28 and eventually leaves the housing 22 via the oil drain 16.

Crankcase gas is further drawn through the through-holes 42 and directed into the undersurface of the blocking wall 44, wherein oil is further separated from the crankcase gas. The oil drops onto the dividing wall 36 and drops onto the bottom wall via the through-holes 42 and the drain tube 46. Crankcase gas is drawn into the second chamber 40 and out the outlet port 14*a*.

Figure 2:
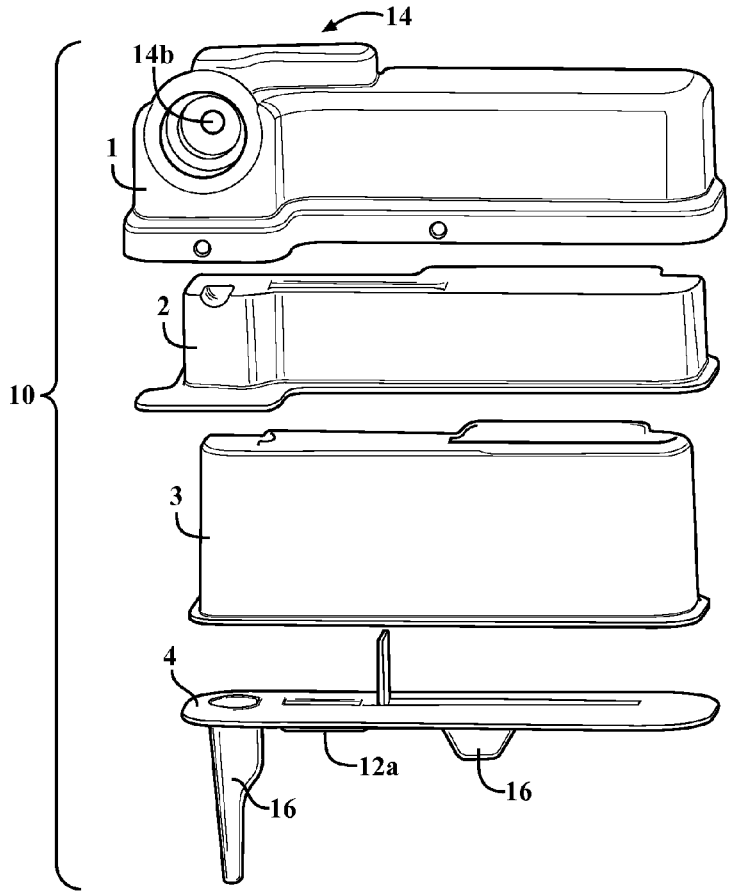
FIG. 2 shows an exploded view of an oil separating device.

With reference again to FIG. 1 and also to FIG. 2, the oil separating device 10 may include a series of various chambers, channels, walls, passages and barriers directed towards separating oil from the crankcase gas prior to directing the crankcase gas through the separation chamber 200*a*, 200*b*. To form the various chambers, channels, walls, etc., the oil separating device 10 can be made of a series of overlaying shells, as shown in FIG. 2. For example, the oil separating device 10 of the preferred embodiment is made from a first shell 1, a second shell 2, a third shell 3, and a fourth shell 4. The first shell 1 is disposed over the second shell 2, the second shell 2 is disposed over the third shell 3, and the third shell 3 is disposed over the fourth shell 4. Mounting the shells 1, 2, 3, and 4 onto one another forms the various structures of the invention. It should be appreciated that FIGS. 1 and 2 are illustrative of, but only one way to practice the invention described herein, and is not meant to be limiting.

As discussed above, the various chambers, channels, and other structures forming the oil separating device 10 are formed by overlaying shells 1, 2, 3, and 4. For example, with reference to FIG. 8, part of the second shell 2 forms the top portion 20 and the axial protrusion 18. The third shell 3 abuts the forth shell 4, which forms the bottom wall 28 of the oil separating device 10.

Obviously, many modifications and variations of the present invention are possible in light of the above teachings and may be practiced otherwise as specifically described while within the scope of the appended claims.

The invention claimed is:

1. An oil separating device for separating oil from crankcase gas generated in an internal combustion engine, the oil separating device comprising:

a first shell, a second shell, a third shell and a fourth shell, the second shell disposed within the first shell, the third shell disposed within the second shell and over the fourth shell, the third shell having a housing, wherein the first shell, the second shell and the third shell are spaced apart from each other so as to define a passage for crankcase gas, the housing having a pair of side walls, a top wall, and a bottom wall so as to define a chamber, the bottom wall having an oil drain;

an inlet disposed on a bottom wall of the fourth shell, the first shell, second shell and third shell are spaced apart from each other so form a passage configured to receive the crankcase gas;

an outlet disposed on the first shell, the first shell, second shell and third shell are spaced apart from each other so form a passage configured to allow separated gases to exit from the oil separating device; and a chamber having a first oil separation portion and a second oil separation portion, the first oil separation portion in fluid communication with the second oil separation portion and disposed in a side-by-side relationship with the second oil separation portion, the first oil separation portion having a separation chamber having an inner wall, the separation chamber is downstream the inlet and upstream the outlet, the separation chamber further including a first end elevated relative to a second end, the first end and the second end are open so as to form a passage extending along an axis, the first end having a larger diameter than a diameter of the second end, the first and second ends disposed on a respective first and second planes, the first and second planes are generally parallel to each other and orthogonal to the axis, the outlet is disposed downstream the second plane and displaced from both the axial length of the passage and second plane;

a dividing wall disposed on a plane generally parallel to the bottom wall, the dividing wall extending between the separation chamber and one of the pair of side walls of the housing and disposed between the top wall and the bottom wall of the housing, the dividing wall including one or more through-holes; and a blocking wall disposed between the dividing wall and the top wall of the housing, the blocking wall having a pair of free ends, the blocking wall disposed on a plane generally parallel to the dividing wall and disposed directly above the one or more through-holes, wherein the crankcase gas enters the separation chamber though the inlet, wherein oil is separated and collects on the inner wall, and crankcase gas exits the second end in the same direction as oil falling along the inner wall, wherein the separated oil drops via gravity and flows to an oil drain, and the gases are carried through the through-holes of the dividing wall so as to impact into the blocking wall wherein oil is again separated from the gases.

2. The oil separating device as set forth in claim 1, wherein the inner wall has a generally frustoconical shape extending along the axis.

3. The oil separating device as set forth in claim 2, further including an axial protrusion extending along the axis from a top portion of the separation chamber.

4. The oil separating device as set forth in claim 2, wherein the inlet includes an inlet passage, the inlet passage being generally perpendicular to the axis so as to feed crankcases gas into the separation chamber in a direction generally perpendicular to the axis.

5. The oil separating device as set forth in 3, wherein the inner wall is at least two inner walls, each inner wall having a frustoconical shape.

6. The oil separating device as set forth in claim 5, wherein an axial protrusion is at least two axial protrusions commensurate with the number of inner walls, and wherein each of the at least two axial protrusions is centered with respect to the diameter of the first end.

7. An oil separating device for separating oil from crankcase gas, the oil separating device having a first shell, a second shell, a third shell and a fourth shell, the second shell disposed within the first shell, the third shell disposed within the second shell and over the fourth shell, wherein the first shell, the second shell and the third shell are spaced apart from each other so as to define a passage for crankcase gas, and wherein the third shell includes a housing, the housing having a first side wall opposite a second, a top wall, the fourth shell defining a bottom wall so as to define a chamber, the bottom wall having an oil drain, the oil separating device comprising:

a first oil separation portion and a second oil separation portion disposed within the chamber, the first oil separation portion having a separation chamber defined by the second side wall of the housing and an inner side wall, the inner side wall generally dividing the housing between the first oil separation portion and the second oil separation portion, the separation chamber having a first end elevated relative to a second end, the first end and the second end are open so as to form a passage extending along an axis the first oil separation portion in fluid communication with the second oil separation portion;

an inlet in fluid communication with the first oil separation portion;

an outlet disposed downstream from the second oil separation portion;

a dividing wall disposed on a plane generally parallel to the bottom wall and orthogonal to the inner side wall, the dividing wall extending between the intermediate side wall and the first side wall of the housing and disposed between the top wall and the bottom wall of the housing, the dividing wall including one or more through-holes; and a blocking wall disposed between the dividing wall and the top wall of the housing, the blocking wall having a pair of free ends, the blocking wall disposed on a plane generally parallel to the dividing wall and disposed directly above the one or more through-holes, wherein crankcase gas enters the oil separation device through the inlet, oil is separated from the crankcase gas by the separation chamber, the separated oil, and crankcase gas flow laterally to the second oil separation portion, the separated oil dropping to the bottom wall and out through the oil drain, the crankcase gas flowing through the through-holes in the dividing wall and directed into blocking wall wherein oil is further separated from the crankcase gas, the crankcase gas flowing out the gas outlet, and the separated oil flowing back to the oil drain.

8. The oil separating device as set forth in claim 7, wherein the separation chamber includes an inner wall having a first end spaced apart from a second end, both the first and second ends are open so as to define a passage, the first end having a larger diameter than the second end, the second end in fluid communication with the second oil separation portion and spaced apart from the bottom wall, wherein the crankcase gas enter the separation chamber through the inlet.

9. The oil separating device as set forth in claim 8, wherein the inner wall has a generally frustoconical shape.

10. The oil separating device as set forth in claim 7, wherein the inlet includes an inlet passage, the inlet passage being generally perpendicular to the axis so as to feed crankcases gas into the separation chamber in a direction generally perpendicular to the axis of the passage.

11. The oil separating device as set forth in claim 7, wherein the separation chamber has at least one narrow wave shaped passage defined by a first undulating surface opposite a second undulating surface mirroring the first undulating surface, the first undulating surface is spaced a predetermined distance apart from the second undulating surface.

12. The oil separating device as set forth in claim 7, further including a drain tube disposed on the dividing wall, the drain tube providing fluid communication between the first chamber and the second chamber of the second oil separation portion.

13. The oil separating device as set forth in claim 7, wherein the blocking wall is disposed directly above the through-holes.

14. The oil separating device as set forth in claim 7, wherein the oil drain is disposed on the bottom wall and is laterally displaced from the second end of the first oil separation portion.

* * * * *